United States Patent [19]

Probst

[11] Patent Number: 4,700,999

[45] Date of Patent: Oct. 20, 1987

[54] CURRENT LEADTHROUGH

[75] Inventor: Georg Probst, Geislingen, Fed. Rep. of Germany

[73] Assignee: GMT Novotny GmbH, Waldkraiburg, Fed. Rep. of Germany

[21] Appl. No.: 894,472

[22] Filed: Aug. 4, 1986

Related U.S. Application Data

[63] Continuation of Ser. No. 627,422, Jul. 3, 1984, abandoned.

[30] Foreign Application Priority Data

Jul. 7, 1983 [DE] Fed. Rep. of Germany ..... 3324466

[51] Int. Cl.[4] ..... H01R 13/52

[52] U.S. Cl. ..... 439/271; 439/682; 439/736

[58] Field of Search ..... 339/60 M, 94 A, 94 M, 339/218 M, 60 R, 64 R, 64 M, 94 R, 218 R, 192 RL; 174/153 R

[56] References Cited

U.S. PATENT DOCUMENTS

| | | | |
|---|---|---|---|
| 2,433,911 | 1/1948 | Johnston | 339/94 A |
| 3,422,392 | 1/1969 | Woods | 339/94 A |
| 3,495,028 | 2/1970 | Tutthill | 174/153 R |
| 3,646,499 | 2/1972 | DeLano et al. | 339/60 M |
| 3,696,321 | 10/1972 | Cooper, Jr. | 339/218 M |
| 3,708,612 | 1/1973 | Saxon et al. | 174/153 R |
| 3,770,878 | 11/1973 | Dozier | 339/218 M |
| 3,842,389 | 10/1974 | Glover et al. | 339/60 M |
| 4,054,354 | 10/1977 | Unger | 339/218 M |
| 4,138,183 | 2/1979 | Soos | 339/94 M |
| 4,310,210 | 1/1982 | Takahashi et al. | 339/64 M |

FOREIGN PATENT DOCUMENTS

| | | | |
|---|---|---|---|
| 1464203 | 12/1969 | Fed. Rep. of Germany . | |
| 1590248 | 9/1973 | Fed. Rep. of Germany . | |
| 2323967 | 11/1974 | Fed. Rep. of Germany . | |
| 2725796 | 12/1978 | Fed. Rep. of Germany | 339/218 M |
| 1019862 | 1/1953 | France | 174/153 R |
| 817345 | 7/1959 | United Kingdom . | |

*Primary Examiner*—Eugene F. Desmond
*Assistant Examiner*—Gary F. Paumen
*Attorney, Agent, or Firm*—McGlew and Tuttle

[57] ABSTRACT

A current leadthrough particularly for a refrigerator comprises an insulator with a plurality of electrically conductive spaced apart pins extending through the insulator. The insulator includes a disc-shaped base portion with a plurality of nub portions corresponding to the member of pins, the pins extending through the nub portions. The nub portions extending upwardly from the base portion and the base portion comprise a material having temperature stability which is insensitive to chemicals and has some elasticity.

9 Claims, 3 Drawing Figures

CURRENT LEADTHROUGH

This application is a continuation of application Ser. No. 627,422, filed July 3, 1984, now abandoned.

FIELD AND BACKGROUND OF THE INVENTION

The invention relates in general to electrical connecting devices and in particular to a new and useful current leadthrough for refrigerators in which a plurality of conductive wires are embedded in an insulator including a base portion and insulator nub portions for each conductive wire extending upwardly from the base portion.

The invention relates particularly to a current leadthrough for refrigerators with hermetically sealed compressors. Known current leadthroughs consist of a metal base and usually three current-carrying alloyed steel pins sealed in glass.

This, however, results in difficulties when coordinating the various materials according to coefficients of expansion and in the production of a great variety of components. Moreover, joining them mechanically or chemically by means of glass sealing under pressure and in a protective gas atmosphere brings with it a considerable primary energy consumption. Overall, this adds up to relatively high costs. The sintered glass conventionally used for this purpose is of a selected porosity which can lead to electrical breakdowns if drying and sealing was imperfect. The corrosion problem must also be considered another disadvantage because the chemical nickel plating of the finished leadthrough can only lead to a qualitatively unsatisfactory compromise between surface protection and fusibility. Other difficulties result from the fact that when the leadthrough is welded into the compressor, the glass metal compound, which is under great stress, is subjected to a thermal shock which can lead to microdamages and very fine glass splinterings of the insulation with subsequent gas leaks. Furthermore, the sealing technique also requires much primary energy, a great electrode consumption and thus considerable costs overall.

Therefore, the problem underlying the present invention is seen in simplifying the production and the assembly, reducing the cost and increasing the functional safety of a current leadthrough with an insulator penetrated by electrically conducting pins. According to the invention, this is achieved in that an insulator is chosen which comprises a material having temperature stability, insensitive to chemicals and which has at least slight elasticity, in particular elastomers, thermoplastics, or the like. This affords gastight anchorage of the leadthrough in the compressor capsule and reliable electrical insulation of the current carrying pins against the compressor capsule. The glass sealing method permits only the use of steel pins, whereas the invention makes possible the arrangement of electrically better conducting brass pins.

Preferably there are disposed on a disc-shaped base one or more nubs accommodating the pins. This results in a likewise gastight connection between the pins and the nubs and, hence, of the complete leadthrough. Base and nubs are preferably molded in one piece, resulting in a particularly simple production method.

According to another characteristic of the invention, each nub has a cylindrical part and, at its free end, a conical part.

A ring-shaped bead is disposed approximately at the transition from the cylindrical to the conical part of the nub. The capsule wall contacts the nub between the disc and this bead, the latter indicating on the one hand the perfect assembly of the leadthrough while serving as resistance against the leadthrough being pushed out of the capsule on the other.

It is expedient for the base to have, at the lower cylindrical part of each nub, a ring bead oriented parallel to it. This bead serves as bearing for the capsule wall and as seal for the latter. Preferably there is provided between each pin and the leadthrough a recess of ring-shaped section, extending from the base approximately to the end of the cylindrical nub part. This facilitates the assembly of the leadthrough because it can be compressed while being inserted and it also acts as an additional seal for the capsule because the internal pressure acts upon the wall of the leadthrough. In addition, it is made possible to disassemble the leadthrough without having to destroy it. To achieve a reinforcement of the base, it has a flange which projects beyond the cylindrical part of the nub. When sealed-in pins are used, expensive contact discs must be welded on, whereas according to the invention the pins merely have upset contact surfaces.

Accordingly, an object of the invention is to provide a current leadthrough particularly for a refrigerator which comprises an insulator with a plurality of electrically conductive spaced apart pins extending through the insulator and wherein the insulator includes a base portion with an insulator nub portion for each pin extending upwardly from the base portion through which the respective pin extends and wherein the base portion is made of a temperature stable material insensitive to chemical action and which some elasticity.

A further object of the invention is to provide a current leadthrough which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
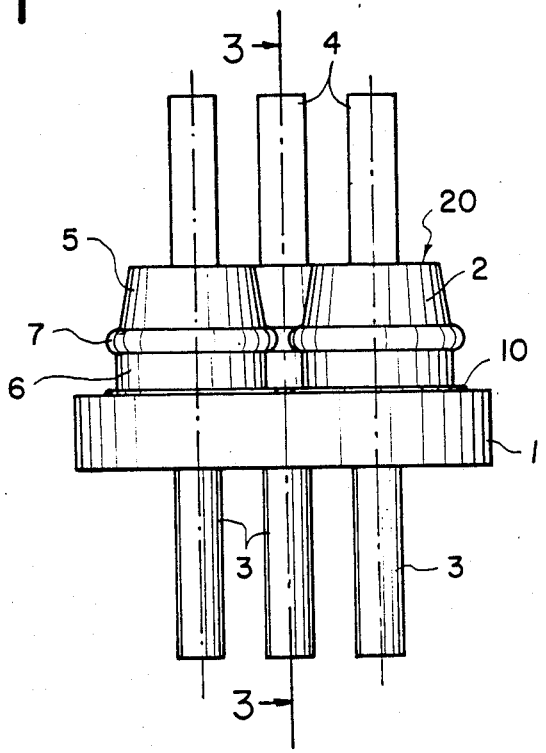
FIG. 1 is a side elevational view of a current leadthrough constructed in accordance with the invention.
Figure 2:
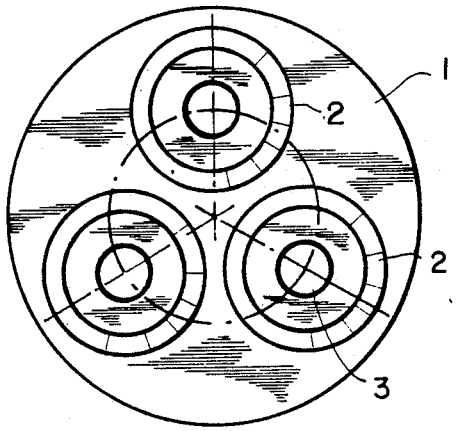
FIG. 2 is a top plan view of the device shown in FIG. 1.
Figure 3:
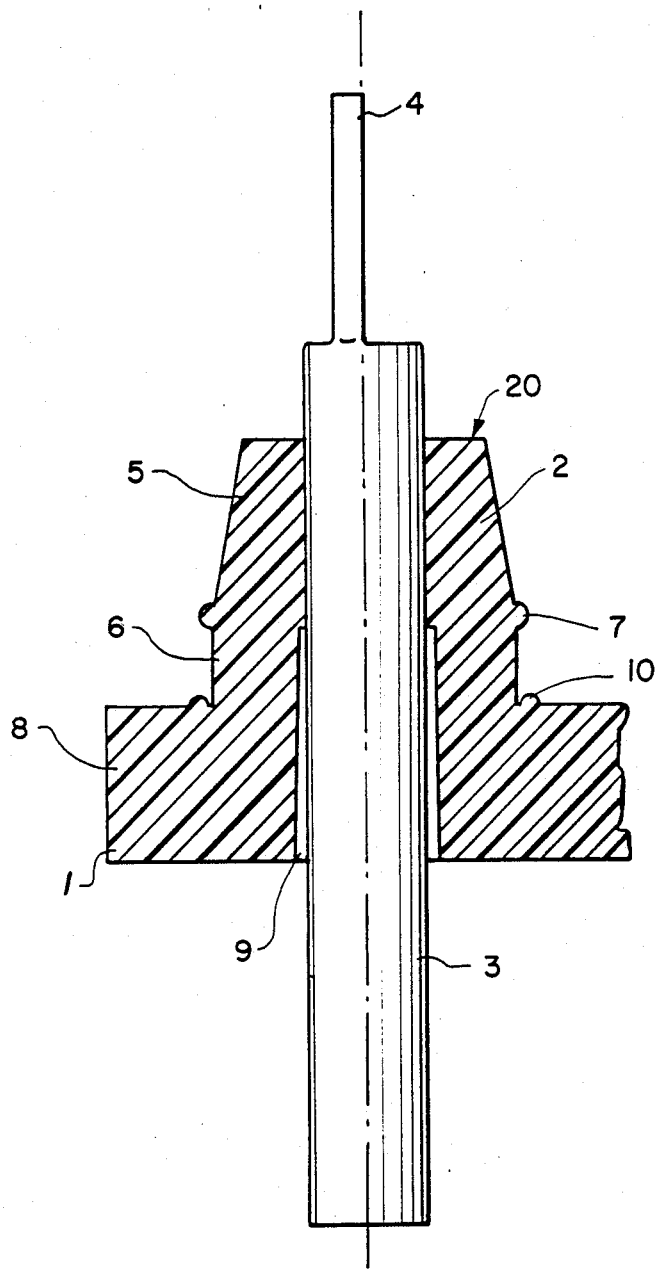
FIG. 3 is an enlarged sectional view taken along the line 3—3 of FIG. 1.

Referring to the drawings in particular, the invention embodied therein comprises a current leadthrough particularly for refrigerators which comprises an insulator generally designated 20 with a plurality of electrically conductive spaced apart pins 3 extending through the insulator. The insulator 20 includes a disc-shaped base portion 1 and an insulator nub portion 2 for each pin 3. A respective pin 3 extends through each nub portion 2 and through the base portion 1. The insulator 20 is in accordance with the invention made of a material having a temperature stability which is insensitive to chemical attack and has some elasticity.

The current leadthrough is designed in the form of a disc-shaped base 1 and consists of an electrically non-conducting elastomer or thermoplastic. At its upper end, the base has three nubs 2 in which an electrically conducting pin 3 each is centrally embedded. The base 1 and the nubs 2 are a one-piece molding. Depending on the electric power to be transmitted, the freely projecting pin ends 4 may be made with or without contact surfaces. The face ends of the nubs 2 have a conical part 5 which serves centering purposes when inserting the leadthrough into a compressor capsule (not shown). The adjacent cylindrical nub part 6 is larger by a selected amount than the associated capsule bore (not shown) and serves as the actual sealing element of the entire leadthrough.

Approximately at the transition from the cylindrical part 6 to the conical part 5 there is disposed a ring-shaped bead 7, against which the not shown capsule wall rests after assembly. It indicates the proper assembly of the leadthrough and also serves as a stop for the compressor capsule to prevent the leadthrough from slipping out unintentionally.

The base 1 is reinforced by a flange 8 which projects beyond the cylindrical part 6 of the nubs 2. It serves as bearing surface for the leadthrough against the capsule wall which rests against the ring bead 10, contributing to the sealing action.

Provided between each pin 3 and the leadthrough is a recess 9 of ring-shaped section, extending from the base 1 to approximately the end of the cylindrical nub part 6. Each recess is formed by a bore in base 1 and cylindrical nut part 6, which has a diameter greater than that of pin 3. The aligned bore in each conical part 5 closely and gas tightly fits around the pin 3. The outer diameter of the cylindrical part 6 of the nubs 2 is slightly larger than the associated bore in the capsule, and the ring-shaped recess makes insertion into the capsule easier due to the elasticity of the nub 2 gained through the recess. After assembly, the internal pressure acts upon the wall of the recess, thus resulting in an additional seal. The connection between the pins 3, which comprises brass or iron, and the nubs 2 is gastight.

The invention relates to a current leadthrough, in particular for refrigerators, with an insulator penetrated by electrically conducting pins 3. The known glass insulators, in which the pins are hermetically sealed, have the disadvantage, among others, that microdamages occur when the leadthrough is welded in. Also, due to insufficient drying of the conventionally used sintered glass there is the danger of great porosity which can lead to electrical breakdowns. In addition, production is relatively costly and complicated. To provide a leadthrough which can be produced inexpensively, is simple in design and completely insulated, the invention utilizes a disc-shaped base 8 with one or more nubs 2 accommodating the pins 3, said base comprises a material of temperature stability, insensitivity to chemicals and at least slight elasticity, in particular elastomers, thermoplastics or the like.

While specific embodiments of the invention have been shown and described in detail to illustrate the application of the principles of the invention, it will be understood that the invention may be embodied otherwise without departing from such principles.

What is claimed is:

1. A current leadthrough particularly for refrigerators, comprising a one-piece insulator including a radially extending disc-shaped base portion and a plurality of axially extending nub portions extending upwardly from a top of said disc-shaped base portion, said nub portions being arranged at spaced locations on said top of said base portion and said base portion extending radially outwardly of said nub portions, and an electrically conductive pin extending through said base portion and each of said nub portions, each pin being gastightly engaged with a nub portion, said insulator comprising a thermoplastic material having temperature stability, being insensitive to chemicals and having some elasticicity, said base portion and said nub portions being molded in one piece, each nub portion having an axially extending bore therein which also extends through said disc-shaped base portion, each bore having a large diameter part in said base portion and in a portion of each nub portion which is greater in diameter than said pin extending through said base portion and each of said nub portions, each bore also having a small diameter part at a location spaced away from said base portion for gas tightly engaging around said pin, said base portion being substantially cylindrical and each nub portion having a lower cylindrical part connected directly to said base portion and said large diameter part of said bore extending into said cylindrical part, an upper frusto-conical part connected on said cylindrical part, said frusto-conical part having a large diameter bottom end connected to said cylindrical part and having about the same diameter as said cylindrical part, said nub including a radially outwardy extending ring-shaped bead connected therearound between said cylindrical and frusto-conical parts.

2. A current leadthrough according to claim 1, wherein said base portion includes a top face containing said nub portions having a ring bead extending around each of said nub portions.

3. A current leadthrough according to claim 2, including a recess defined between said insulator and each conductive pin extending upwardly from the bottom of said base portion substantially through said cylindrical portion of said nub portion.

4. A current leadthrough according to claim 3, including a flange reinforcing said base portion projecting outwardly around said nub portions.

5. A current leadthrough according to claim 4, wherein said pins have upper free ends with upset contact surfaces.

6. A current leadthrough for refrigerators, comprising a one-piece insulator including a radially extending base portion and a plurality of axially extending nub portions extending upwardly from a top of said base portion, said nub portions being arranged at spaced locations on said top of said base portion and said base portion extending radially outwardly from said nub portions, a plurality of electrically conductive pins extending through said base portion, each of said pins extending through one of said nub portions, said insulator comprising a thermoplastic material having temperature stability and being insensitive to chemicals and having some elasticity, said base portion and said nub portions being molded in one piece, each nub portion having an axially extending bore therethrough which also extends through said base portion, each bore having a large diameter part in said base portion and in a portion of said nub portion which is larger in diameter than said pin extending through said base portion and each of said nub portions, each bore also having a small diameter part at a location spaced away from said base portion for tightly engaging around said pin, said small diameter part being entirely in its respective nub portion, said large diameter part of each bore defining an annular space around said pin in the vicinity of said base portion and in the vicinity of part of each nub portion, each nub portion having a cylindrical part surrounding said large diameter part of said bore and a frusto-conical part connected to said cylindrical part and surrounding said small diameter part of said bore.

7. A current leadthrough according to claim 6, wherein said base portion is cylindrical and disc shaped.

8. A current leadthrough according to claim 7, wherein each nub portion includes an annular bead positioned between said cylindrical and said frusto-conical parts.

9. A current leadthrough according to claim 8, including a ring shaped bead disposed on said top of said base portion and surrounding each of said cylindrical parts of each of said nub portions.

* * * * *